United States Patent [19]

Thesingh

[11] 4,078,353

[45] Mar. 14, 1978

[54] MEANS AND METHOD FOR CONSTRUCTION OF BUILDINGS

[76] Inventor: Cettien Thesingh, 20 Laurel Chase, Forestville, New South Wales, Australia, 2087

[21] Appl. No.: 771,343

[22] Filed: Feb. 23, 1977

[30] Foreign Application Priority Data

| | | |
|---|---|---|
| Feb. 23, 1976 | Australia | PC4944 |
| Oct. 1, 1976 | Australia | PC7581 |

[51] Int. Cl.[2] ..... E04B 1/35

[52] U.S. Cl. ..... 52/741; 52/92; 52/223 R

[58] Field of Search ..... 52/741, 745, 742, 92, 52/DIG. 11, 223 R

[56] References Cited

U.S. PATENT DOCUMENTS

| | | | |
|---|---|---|---|
| 305,584 | 9/1884 | Forrest | 52/92 |
| 1,062,994 | 5/1913 | Pruden | 52/92 X |
| 1,162,432 | 11/1915 | Aagaard | 52/92 |
| 1,428,484 | 9/1922 | Lankheet | 52/223 R |
| 1,924,414 | 8/1933 | Ring | 52/745 |
| 2,270,161 | 1/1942 | Briggs | 52/92 |
| 3,289,362 | 12/1966 | Whelan | 52/92 |
| 3,830,024 | 8/1974 | Warnke | 52/DIG. 11 |
| 3,969,862 | 7/1976 | Kuss | 52/92 X |

FOREIGN PATENT DOCUMENTS

| | | | |
|---|---|---|---|
| 929,591 | 12/1947 | France | 52/92 |
| 856,009 | 5/1940 | France | 52/92 |
| 766,543 | 6/1934 | France | 52/92 |

OTHER PUBLICATIONS

Progressive Architecture, Feb. 1963, p. 79, "New Products".

*Primary Examiner*—Leslie Braun

*Attorney, Agent, or Firm*—Finnegan, Henderson, Farabow & Garrett

[57] ABSTRACT

The invention of the present application relates to improved means and method of construction of buildings which will not only reduce the time required for construction of the framework but also requires almost no skilled labor. Essentially, the invention provides a method of constructing a building comprising the following steps:

a. pivotally connecting together bottom plate members of predetermined lengths, b. connecting a cable templet means between said bottom plate members, said cable templet means having cables of predetermined length and extending from an interconnected means, c. tensioning said cables to form a rigid bottom plate boundary, d. connecting a wall means to said rigid bottom plate boundary, said wall means having at least one upright stud means and a top plate member, e. securing said at least one upright stud means to respective bottom plate member, f. connecting a further cable templet means between said top plate members, said further templet means having cables of predetermined length and extending from a further interconnecting means, g. tensioning said further cables to form a rigid top plate boundary, and h. connecting a roof structure to said top plate boundary.

5 Claims, 13 Drawing Figures

MEANS AND METHOD FOR CONSTRUCTION OF BUILDINGS

This invention relates to buildings and more particularly to improvements relating to the construction of buildings.

Under present day methods of construction, a considerably long time is required to construct a building to the stage that it is substantially weather proof. Time delays due to inclement weather result in added expense of the building which is constructed under normal conditions, since there is a wastage of skilled labour which is required for conventional construction. Accordingly, the cost of building is extremely high and often out of financial reach for the average family.

The invention of the present application overcomes the above disadvantages by providing a method of construction which can be readily applied by any handyman, thereby obviating the need for skilled craftsmen which would substantially reduce the ultimate cost of the building.

Further, the invention of the present application provides a building which can be constructed to the weather proof stage in a surprisingly short time further lowering the cost of the building.

Moreover, the construction according to the present invention provides a structure which will withstand most natural disasters such as earthquakes, cyclones, hurricanes, etc.

The present invention will now be described with reference to several preferred embodiments illustrated in the accompanying drawings, wherein for convenience, identical numerals will be used to identify similar integers:

Figure 1:
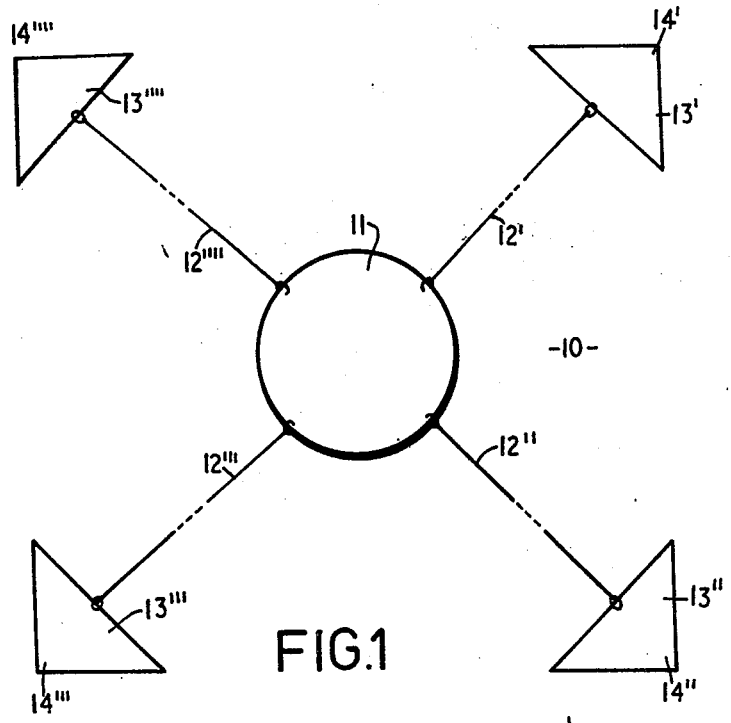
FIG. 1 illustrates one form of templet device.

As may be seen from FIG. 1, there is illustrated a templet device 10 which may be used for the construction of a regular four sided building, e.g. a square or a rectangle. The templet device 10 comprises a disc member 11 to which is connected four similar cables 12 of equal length. The points of connection of the cables 12 are evenly spaced along the periphery of the disc 11 such that diagonals drawn between the cables intersect at the centre point of the disc. A right triangular member 13 is connected to each of the four cables at the end of the cable 12 which is adjacent the disc member 11.

Each of the triangular members 13 includes a right angle 14 and the cable 12 is connected along a line which bisects the right angle 14. In effect then, for each element comprising the disc 11, cable 12 and triangular member 13, the distance between the centre of the disc and the tip of the right angle 14 of each of the triangular members 13 should be equal.

It should be understood that all the construction members should preferably be extrusions or prefabricated from suitable material. This would permit easy and fast assembly of the members which would reduce labour costs as well as allow the members to be mass produced thereby reducing manufacturing costs. In the present preferred embodiment the structural members should be made of aluminium.

Figure 2:
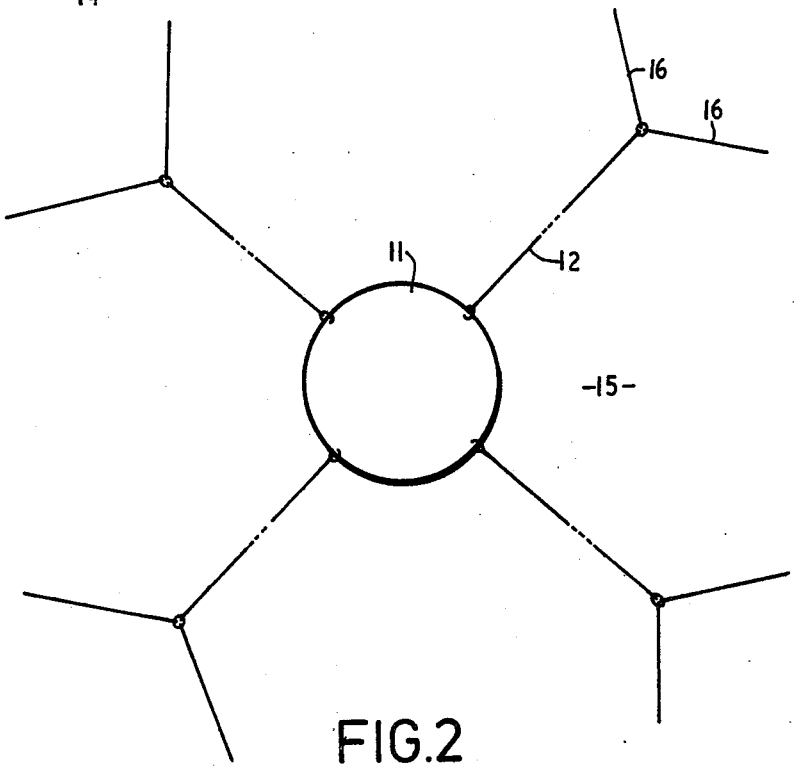
FIG. 2 illustrates another form of templet device.

FIG. 2 illustrates another form of templet device 15 which is basically similar to the templet device 10 of FIG. 1. As with the templet device 10, the templet 15 would also be used for the construction of a regular four sided building. The only difference between the templet 10 and the templet 15 is that the latter has displaced the triangular members 13 with two further cables 16. The further cables 16 are all of equal length and a pair of them is fastened to the end of the cable 12.

Figure 3:
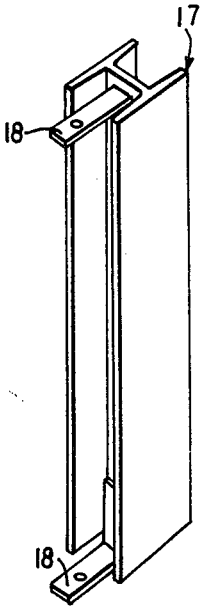
FIG. 3 illustrates one form of support stud.

FIG. 3 illustrates a stud member 17 which can be used to support the top plate and roof structure. On the top and bottom of the stud member 17 there are fastened L-shaped flanges 18.

Figure 4:
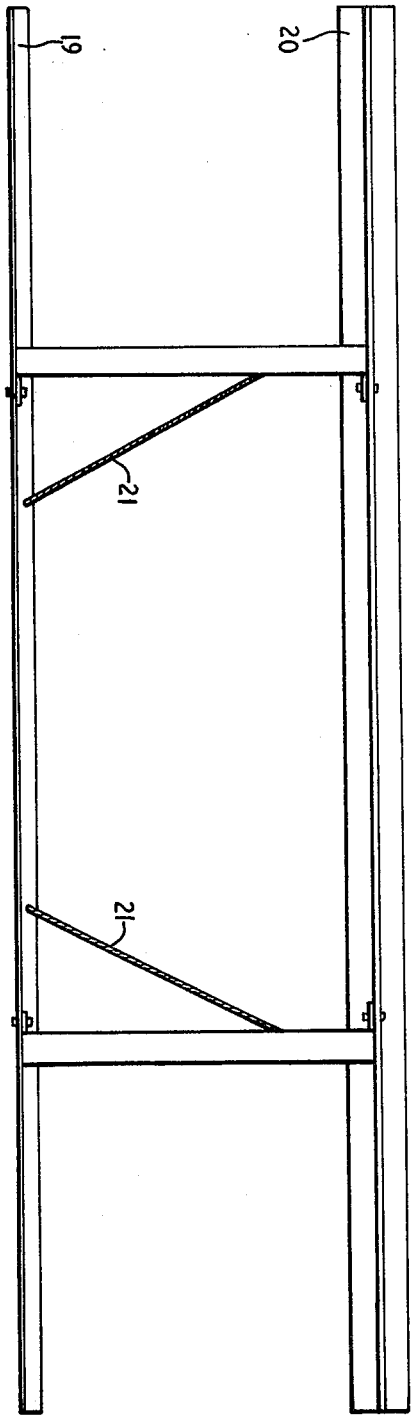
FIG. 4 illustrates an elevational view of a side wall.

As may best be seen in FIG. 4, the stud 17 is maintained on and fastened to an angled bottom plate 19 by fastening the bottom flange 18 to the bottom plate 19. Similarly, a top plate 20 in the form of a T-shaped member is situated on top of the studs 17 and the top flange 18 is fastened to the top plate. Guy wires 21 extending between the studs 17 and bottom plate 19 hold the wall section rigidly.

Figure 5:
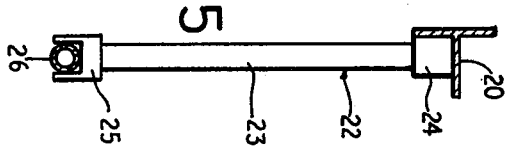
FIG. 5 illustrates another form of support stud.

FIG. 5 illustrates another form of stud 22 which may be used with tubular members. The stud 22 comprises an elongated tubular member 23 and a coupling member 24 fastened at the top and bottom of the tubular member 23. The coupling member 24 is capable of sliding along a tubular top and bottom plate. As with the previous embodiment the studs are fastened by guy wires to the bottom plate. It should of course be understood that in each of the embodiments the guy wires could extend between the studs and the top plate, as opposed to the bottom plate, to form a rigid assembly.

Construction of the building will now be described. For convenience, the construction will be limited to a peripherally square building. Starting from a particular reference line a foundation pier is constructed at a particular point. Using the templet device 10 the right angle 14 of the triangular member 13 is then fastened to the pier. An aluminium bottom plate 19 which is in the form of an angle member as mentioned earlier is then also fastened to the pier such that the side of the bottom plate 19 and the appropriate right angular sides of the triangular member 13 both extend along the reference line. Next, the second triangular member 13 is attached to the adjacent end of the bottom plate 19 such that when the disc is pulled in a direction transverse to the bottom plate 19, the angle between the tensioned cables is 90 degrees. A second pier is then erected underneath the adjacent end of the bottom plate 19. This procedure then provides the first bottom plate of the building. To locate the position of the third pier a second angle bottom plate 19 is pivotally attached to the second triangular member 13" such that each of the bottom plates 19 lie in line with the respective right angular sides of the second triangular member 13″. The third triangular member 13‴ is then fastened to the adjacent end of the second bottom plate 19″ and the templet device again tensioned such that each of the cables connected to the angle members are at 90°. At that point a third pier is constructed underneath the adjacent end of the second bottom plate 19″, the second bottom plate 19″ and the third triangular member 13‴ being fastened to the pier. A third bottom plate 19‴ is then pivotally attached to the third pier and the fourth triangular member 13⁗ is attached to the adjacent end of the third bottom plate 19‴. As previously described, the location of the fourth pier is found by tensioning the templet device such that, for a square building, the adjacent cables are at 90°. The fourth pier is then constructed underneath the adjacent end of the third bottom plate 19‴. Since the three bottom plates form the sides of a square the fourth bottom plate 19⁗ should fit exactly between the third 19‴ and first bottom plate 19′.

In effect then, this part of the construction defines the base perimeter of the building whilst the templet provides a tie means between each of the bottom plate angle pieces.

With regard to the use of the templet 15 and say tubular bottom plates, a similar procedure is used. The primary difference being that a coupling 25 (see FIG. 6) is placed over each of the ends of the tubular bottom plate 26. The coupling 25 includes a flange 27 which has a hole 28 therein. The coupling 25 may be free to rotate on the tubular bottom plate 26. In order to maintain the couplings apart at a predetermined fixed distance, a locking collar 50 may be fastened to the inner ends of the bottom plate 26. Since the forces on the coupling will be inwardly, no locking collars are necessary on the outer ends of the bottom plate 26. The aforementioned procedure is basically repeated, the only difference being that the further cables 16 of the templet 15 are connected between the adjacent bottom plates. Therefore, after the first bottom plate is positioned, the next bottom plate is pivotally connected by means of the couplings and by passing a pin through each of the respective holes 28 (see FIG. 7). The templet is then tightened such that the cables 12 form a right angle. The procedure is then repeated until the whole of the bottom plate is assembled. As an alternative, the further cables 16 could be eliminated altogether from the last mentioned embodiment. In this alternative templet, the cables 12 could be directly connected to the pivot point in holes 28.

The side walls are constructed next by fastening the studs to the top plate. For rigidity at least two studs should be used in spaced apart relationship. Of course, it should be realised that the studs should be so positioned that they would not obstruct openings such as windows and doors. Each of the side walls should be constructed in a similar manner.

Positioning the side walls onto the bottom plates is achieved by means of pulleys and tie wires whilst squaring off of the top plate is again achieved by use of a templet similar to that used for squaring off the bottom plates. That is, referring to the embodiment in FIG. 4 and the templet of FIG. 1, a triangular member 13 of the templet 10 is attached to each end of the first top plate 20′. The connected stud members 17 are then placed against the rising side of the angle bottom plate 19 and the side wall is raised into an upright position by means of a pulley. The bottom flanges 18 of the I-beam studs 17 are then bolted to the base plate. For added rigidity guy wires 21 are tensioned between the bottom plate 19 and each of the I-beam studs 17. The wall is then trued such that it is vertically upright and in line with the bottom plate 19. The wall can then be more securely fastened by any suitable means. Upon tensioning the templet the angle between the cables should be 90°.

By a similar procedure the second wall is raised into the upright position and the I-beam studs 17 fastened by means of bolts and tie wires. Preferably, the third triangular member 13‴ should be attached to the appropriate end of the second top plate 20″ before raising the second wall, as this procedure would prevent the wall from falling outwardly. At the adjacent end of the top plate the second triangular member 13″ is, of course, connected to the second top plate 20″ after the wall has been raised, since that member was already connected to the first top plate 20′. Once again, the templet is tensioned such that the angle between the cables connecting the top plates 20 define 90°. No further truing is necessary at this stage as the templet would then dictate that the wall is vertical and correctly aligned. This procedure is further repeated for the other remaining walls. It should be noted that in this instance also the second templet device acts as a tensioning device binding the entire top plate structure.

With regards to the embodiment shown in FIG. 5, the construction of the wall would be substantially similar to that of the aforementioned construction. The main advantage of using the studs shown in FIG. 5 is that raising the wall onto the bottom plate 26 (see FIG. 6) would be much easier due to the free rotation of the coupling 25 over the tubular bottom plate 26. To maintain the studs in position, collars similar to those shown in FIG. 6 could be placed on the inner side of the bottom plate 26.

Again, it should be realized that any one of the aforementioned templet constructions could be used for truing the top plate construction.

As to the construction, various embodiments are possible.

Figure 8:
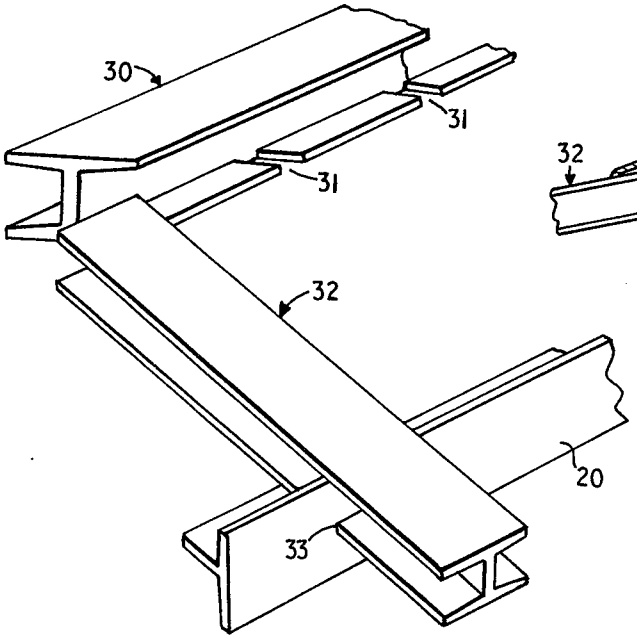
FIG. 8 illustrates one form of roof construction.

Firstly, as shown in FIG. 8, the roof of the building can be readily constructed by again using I-beams for both the ridge piece and the rafters. In this construction the ridge piece 30 should have slots 31 cut into the bottom sides of the I-beam. The rafters 32 should also have a slot 33 cut through one face and web thereof to co-operate with the top plate end of the I-beam. To assemble the roof structure then, all that is required is that the end of the rafter 32 be inserted into the slot 31 in the ridge piece 30. The upstanding portion of the T-shaped top plate 20 is then inserted into the slot 33 in the rafter and the ridge piece 30 is raised until an adjacent rafter 32 is placed into position. The rafters 32, when placed on adjacent sides of the ridge piece 30 support the ridge piece in raised position. Further rafters 32 may then be positioned into the relevant slots on the opposite side of the ridge piece until the roof structure is completed.

Figure 9:
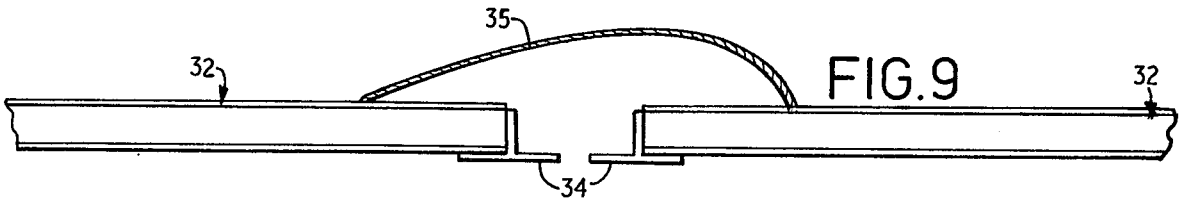
FIG. 9 illustrates an elevational view of another form of the roof construction.
Figure 10:
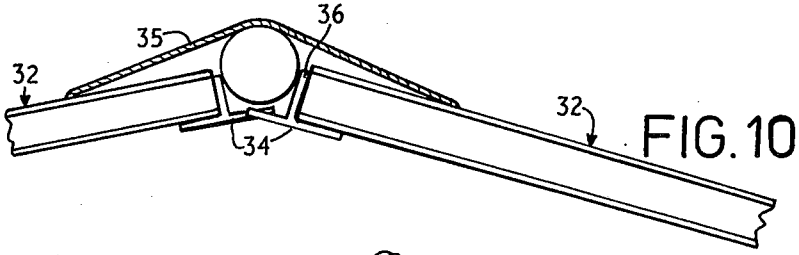
FIG. 10 illustrates an elevational view of the roof construction shown in FIG. 9 positioned on the building.
Figure 11:
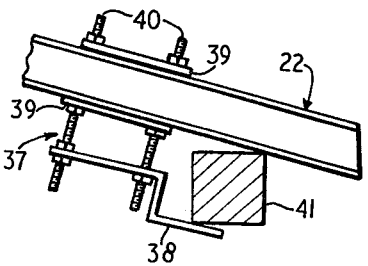
FIG. 11 illustrates a perspective view of the assembly plates shown in FIG. 10 used for positioning the roof rafters on the top plate of the building.
Figure 11:
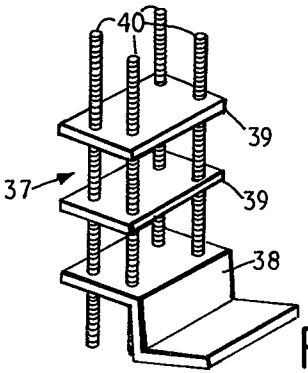

Referring to FIGS. 9 to 11 in general, the roof construction includes a roof ridge piece 30 which in this embodiment is shown to be cylindrical in shape. Spaced at regular intervals or where required are inverted T-shaped members 34 positioned on opposite sides of the cylindrical ridge piece 30. Roof rafter members 32 are positioned and then fastened to the inverted T-shaped members 34, such that oppositely positioned rafter members 32 form a pair. Each pair of rafter members 32 is then interconnected by means of a cable 35 which passes over the cylindrical ridge member 30. As an alternative construction, the cable could pass through appropriate holes (not shown) in the upright fins 36 of the inverted T-shaped members 34 relative to the inverted T-shaped member shown in FIG. 1 and over the cylindrical ridge member 30.

As seen in FIG. 9, when the roof structure is assembled on the ground the cable 35 is loose or slack when initially fastened to the rafter member pair, the amount of slack in each of the cables 35 for each pair of rafter members being uniform. The amount of slack in the cable is directly related to the angle of roof pitch after assembly.

As may be seen from FIGS. 10 and 11, the clamping means 37 used for locking each of the rafter members 32 onto the top plate 41 comprises a substantially Z-shaped coupling member 38, two rectangular plates 39 and a number of bolts 40 for fastening the locking means 37 to a rafter member 32 and the top plate. The two rectangular plates 39 sandwich the roof rafter 32 therebetween whilst the Z-shaped member 38 is fastened under the bottom rectangular plate 39 along one face whilst an edge and another face abut against the top plate member 41.

For assembly of the roof onto the building, all that would be required is for a crane or the like to hoist the roof structure on top of the building. Each of the clamping means 37 could then be slid down each of the roof rafters 32 such that each of the Z-shaped members 38 would lock against the top plate 41. Fastening the bolts 40 on each of the clamping means 37 would then provide a rigid roof structure. It should be appreciated that since the amount of slack in the cable is uniform between each pair of roof rafters the angle of pitch of the roof would be constant. Moreover, the edge of the Z-shaped member 38 which abuts the top plate member 41 provides a hinge or pivot point. The construction of this embodiment is adaptable to any pitch of roof.

Figure 6:
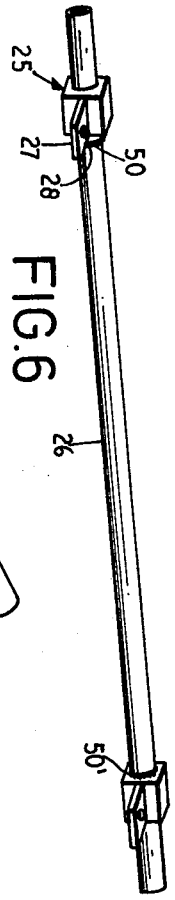
FIG. 6 illustrates a bottom plate and coupling.
Figure 7:
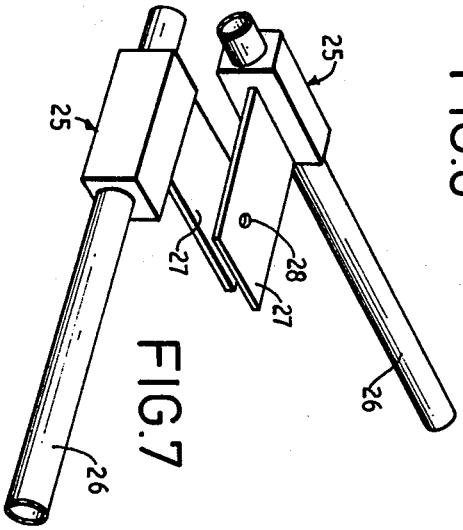
FIG. 7 illustrates the manner in which the bottom plates and couplings shown in FIG. 6 are pivotally connected.
Figure 12:
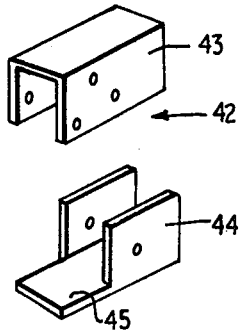
FIG. 12 illustrates a perspective view of another form of roof rafter coupling.
Figure 13:
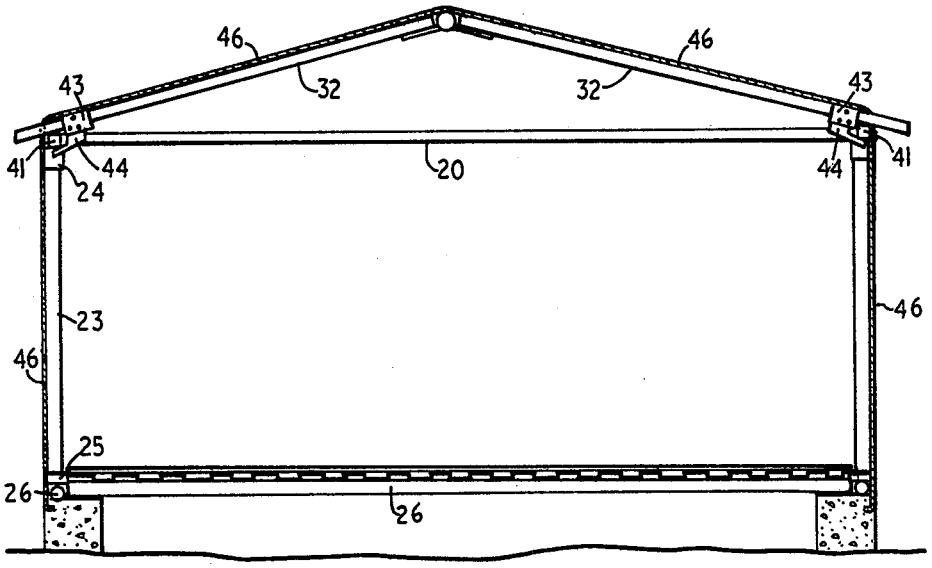
FIG. 13 illustrates a cross-sectional view of a building using the coupling of FIG. 12.

In a still further alternative roof construction as may be seen from FIGS. 12 and 13, all the roof rafters 32 are connected at one end to the ridge piece 30 via a coupling similar to coupling 27 (see FIG. 6). At the opposite end of each of the rafters there is slidably positioned another coupling 42. The coupling 42 comprises an upper component 43 and a lower component 44. The upper component 43 is basically U-shaped and extends over the top and sides of the rafter 32. The bottom component is also U-shaped in cross-section and it is pivotally connected to the upper component. The lower component includes a protruding tongue 45 which extends in the direction of the end of the rafter 32. For construction of the roof all that is required is for the ridge piece 30 to be raised and each of the couplings 42 slid down such that the tongues 45 abut and lock against the lower face of the top plate 41. Each of the top and bottom components 43 and 44 are then locked together thereby providing a rigid roof structure.

Finally, as may best be seen in FIG. 13, to ensure that the structure is cyclone or hurricane proof a cable 46 could be fastened to extend from the foundation through the studs, over the ridge piece, down the studs on the opposite side of the building and fastened to the foundations also on the opposite side of the building.

The roof may then be tilted or otherwise covered thereby providing substantial protection from the weather. Cladding, positioning of windows, wall divisions within the building to form rooms, etc., can then be accomplished by any suitable means.

Various modifications can be introduced to the present invention. For example, the foundations may be constructed beforehand and the templet device used primarily for squaring the building. Also, it would be possible to attach the templet to the ends of top plates on opposite sides of the building and the side walls raised simultaneously such that the adjacent cables when in tension are all at 90°. Further, by using various angles on the disc, any shaped building may be designed. Moreover, in view of the systematic method involved in the construction of the present invention, prefabricated members which are colour coded are ideal as this would obviate any errors.

It should be appreciated that further modifications to the aforementioned invention will become obvious to a skilled artisan and it is hereby intended that these be included within the scope of the present invention.

What I claim is:

1. A method of constructing a building comprising the following steps:

a. pivotally connecting together bottom plate members of predetermined lengths;
b. connecting a cable templet means between said bottom plate members, said cable templet means having cables of predetermined length and extending from an interconnecting means;
c. tensioning said cables to form a rigid bottom plate boundary;
d. connecting a plurality of wall means to said rigid bottom plate boundary, each said wall means having at least one upright stud means and a top plate member;
e. securing said at least one upright stud means of each said wall means to a respective bottom plate member;
f. connecting a further cable templet means between said top plate members, said further cable templet means having cables of predetermined length and extending from a further interconnecting means;
g. tensioning said further cables to form a rigid top plate boundary; and
h. connecting a roof structure to said top plate boundary.

2. The method of claim 1 further including the step of connecting another cable to and between said at least one upright stud and its respective bottom plate member and tensioning said another cable to secure the upright stud.

3. The method of claim 1 wherein said roof structure is formed by the steps of providing a ridge piece and a plurality of rafter members,
forming slots in said ridge piece at predetermined intervals along said ridge piece to receive cooperating ends of said rafter members,
forming a slot in and adjacent one end of each rafter member, and
connecting said rafter members to and between said ridge piece and said top plate boundary, the slots in said rafter members locating on the top plate members and the rafter members extending from and locating in the slots in said ridge piece.

4. The method of claim 1 wherein the step of connecting the roof structure comprises the steps of providing a ridge piece and a plurality of rafter members swingably extending therefrom, providing a coupling slidable on and encircling each rafter member, said coupling comprising an upper component and a lower component pivotally connected thereto, said lower component having a tongue extending towards said top plate boundary, sliding each said coupling towards said top plate boundary to locate said tongue under the respective top plate member, setting the desired roof pitch and fastening the lower component of each coupling to said upper component to lock the rafter member to their respective top plate members.

5. The method of claim 1 further including the steps of connecting at least one cable to a foundation at one side of the building, passing the cables up said wall means, over a ridge piece in said roof structure, down said wall means on the opposite side of the building, connecting the cables to the foundation on the opposite side of the building, and tensioning the cables.

* * * * *